US006270450B1

(12) United States Patent
Niemeyer

(10) Patent No.: US 6,270,450 B1
(45) Date of Patent: Aug. 7, 2001

(54) GUIDING ROLLER FOR WEB MATERIAL

(75) Inventor: Friedel Niemeyer, Melle (DE)

(73) Assignee: Stowe Woodward AG, Stukenbrook (DE)

( * ) Notice: Subject to any disclaimer, the term of this patent is extended or adjusted under 35 U.S.C. 154(b) by 0 days.

(21) Appl. No.: 09/402,626

(22) PCT Filed: Jan. 16, 1999

(86) PCT No.: PCT/EP99/00224

§ 371 Date: Oct. 7, 1999

§ 102(e) Date: Oct. 7, 1999

(87) PCT Pub. No.: WO99/40008

PCT Pub. Date: Aug. 12, 1999

(30) Foreign Application Priority Data

Feb. 7, 1998 (DE) ..... 198 04 909

(51) Int. Cl.[7] ..... B23P 15/00

(52) U.S. Cl. ..... 492/56; 492/36; 492/45; 492/40

(58) Field of Search ..... 492/16, 17, 18, 492/20, 30, 36, 40, 45, 56

(56) References Cited

U.S. PATENT DOCUMENTS 691,011 * 1/1902 Sheehan .
1,883,184 * 10/1932 Weber .
3,951,484 * 4/1976 Bowman .
3,957,147 * 5/1976 Specht .
3,964,658 * 6/1976 Edwards .

FOREIGN PATENT DOCUMENTS 1 164 653 4/1956 (DE) .
1 106 593 6/1957 (DE) .
11 78 257 B 9/1964 (DE) .
33 11 095 10/1984 (DE) .
196 22 238 C 9/1997 (DE) .
6-263300 9/1994 (JP) .
6-263301 9/1994 (JP) .
6-277734 10/1994 (JP) .

* cited by examiner

*Primary Examiner*—I Cuda Rosenbaum
(74) *Attorney, Agent, or Firm*—Connolly Bove Lodge & Hutz

(57) ABSTRACT

A guide roller for web material, in particular for paper-handling machinery, has two outer tube sections (2, 2') and optionally at least one tube section (1) arranged between these. The tube sections (1; 2; 2') are supported on a central shaft (3) through ball bearings (5; 6; 7), and the outer tube sections (2; 2') are adjustable radially relative to the shaft (3) at their outer ends. The ends (1*a;* 2*a*) of the tube sections (1, 2) that are adjacent to each other fit into each other and are connected directly to each other so as to non-rotatable, the ball bearing (5) being situated beneath the area of overlap (1*a,* 2*a*) and the outer tube sections (2; 2') being configured elastically in the longitudinal direction.

4 Claims, 1 Drawing Sheet

GUIDING ROLLER FOR WEB MATERIAL

TECHNICAL FIELD

The present invention relates to a guide roller for web material in particular for paper handling machinery.

BACKGROUND OF THE INVENTION

In known guide rollers of this type (DE 196 22 238 C1), two outer tube sections and a middle tube section are connected through couplings so as to rotate in unison. All tube sections are rigid. These guide rollers are used solely to align the web material.

Also known is a guide roller (DE-AS 11 78 257) that has two outer tube sections and a center tube section that is arranged therebetween. The outermost tube sections are supported on a central shaft through ball bearings. The ends—on the one hand of the outer tube sections and on the other hand of the central tube section—that are adjacent to each other fit around each other and are joined to each other so as to be rotationally fixed. The tube sections are supported by the bail bearings in the overlap area where the tubes fit around each other. In known guide rollers of this type the outer ends of the outer tube sections cannot be adjusted radially relative to the shaft. In addition, in the case of this known guide roller, since all the tube sections are configured so as to be rigid in and of themselves, such guide rollers can be used only to align the web material.

Also known are transverse-tightening rollers that tighten the web material solely across its width. Such transverse-tightening rollers incorporate a plurality of individually supported tube sections that are arranged in an arc; all of these are joined by way of couplings so as to rotate in unison. It is also known that all of the tube sections can incorporate slits that extend part way around the periphery of the tube section and are offset relative to each other, so as to make the tube sections elastic.

SUMMARY OF THE INVENTION

Proceeding from the known prior art, it is the objective of the present invention to create a guide roller that can also act as a transverse-tightening roller and that requires a relatively small amount of drive power.

This objective has been achieved with the features of the present invention: guide roller for web material for paper-handling machinery. The guide roller includes two outer tube sections and optionally at least one tube section arranged therebetween, the tube sections being supported on a central shaft through ball bearings, the outer tube being adjustable radially relative to the shaft at their outer ends. The ends of adjacent tube sections that are adjacent to each other fit into each other and are connected directly to each other so as to be non-rotatable, the ball bearing being situated beneath the area of overlap and the outer tube sections being configured elastically in the longitudinal direction.

The guide roller according to the present invention is of simple construction and can act as both a guide roller and a transverse-tightening roller; it is thus universally usable.

BRIEF DESCRIPTION OF THE DRAWINGS

One preferred embodiment of the present invention is described in detail below on the basis of drawings appended hereto. These drawings show the following.

DETAILED DESCRIPTION OF THE PREFERRED EMBODIMENTS OF THE INVENTION

Figure 1:
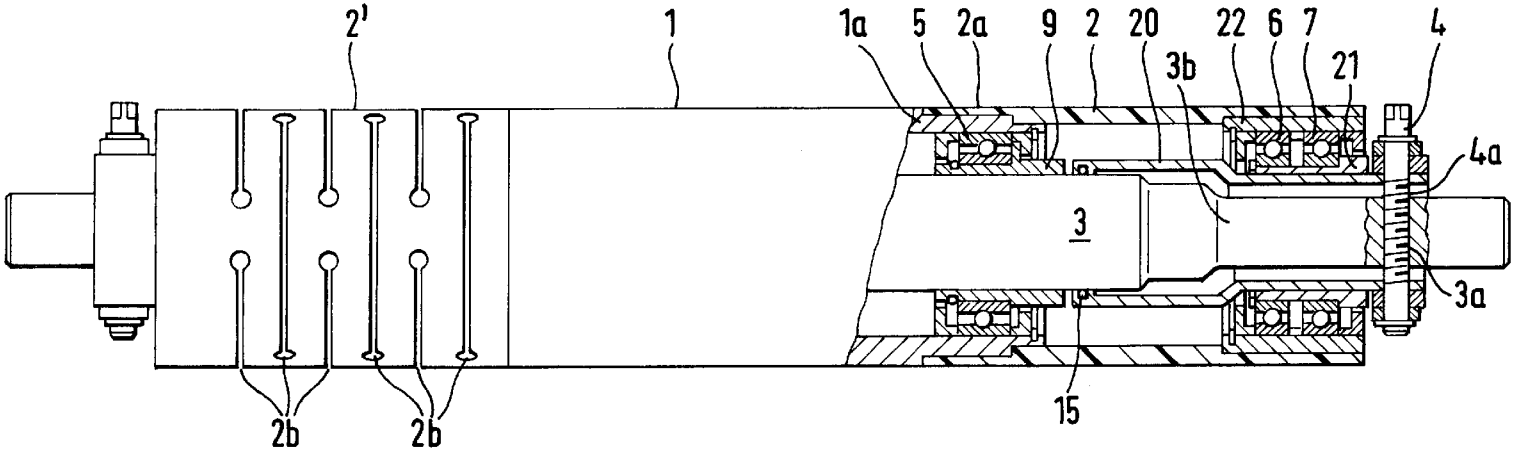
FIG. 1: A side view of the guide roller according to the present invention, in parallel cross section.

The guide roller shown in FIG. 1 incorporates a central shaft 3, on which a central tube section 1 is supported by two ball bearings 5, each of which is installed at the ends 1*a*. The inner rings of these bearings are seated on the bearing sleeves 9 that surround the shaft 3. Only the area of the right-hand bearing area is shown in the drawing. The outer tube sections 2 and 2' are adjacent to the middle tube section 1; these are arranged and supported, and operate so as to be mirror-symmetrical to each other.

The outer end of the tube section 2 is supported on a sleeve 20 by its outer end through two ball bearings 6, 7. The sleeve 20 is adjacent to the ball bearing 5, with its inside diameter on the outer periphery of the shaft 3 and is supported thereon by an O-ring 15. The sleeve 20 is configured so that it encloses the shaft 3 and an area 3*b* of the shaft 3 that is of reduced diameter, being spaced apart from the area 3*b*. This space is large enough so that radial displacement can be effected by the threaded spindle 4. The threaded spindle 4 includes a threaded section 4*a* that is screwed into a threaded section 3*a* that passes transversely through the shaft 3.

The threaded spindle 4 passes through the sleeve and is fixed relative to this. Rotation of the threaded spindle twists the sleeve 20 relative to the shaft 3. The outer end of the sleeve 20 is enclosed by a bearing pushing 21 on which the ball bearings 6 and 7 rest. The ball bearings 6 and 7 are accommodated in a bearing bushing 22 that supports the outer end of the tube section 2. The end 1*a* of the center tube section 1 is of reduced diameter and fits inside the inner end 2*a* of the outer tube section 2. Thus there is a continuous transition between tube sections 1, 2 and 1, 2'. The ball bearing 5 is arranged beneath the ends 1*a*, 2*a* that form the overlap area. This means that the outer tube section 2 is elastically configured so that it is curved in an arc by twisting the sleeve 20. It can be made of plastic.

In order to increase or enhance the elasticity, the outer tube sections 2, 2' can incorporate slits 2*b*, as is shown in FIG. 1, at the left-hand end of the outer tube section 2'. These slits extend around part of the periphery of the outer tube section 2'. Each pair of adjacent slits is offset relative to the other in the peripheral direction.

Figure 2:
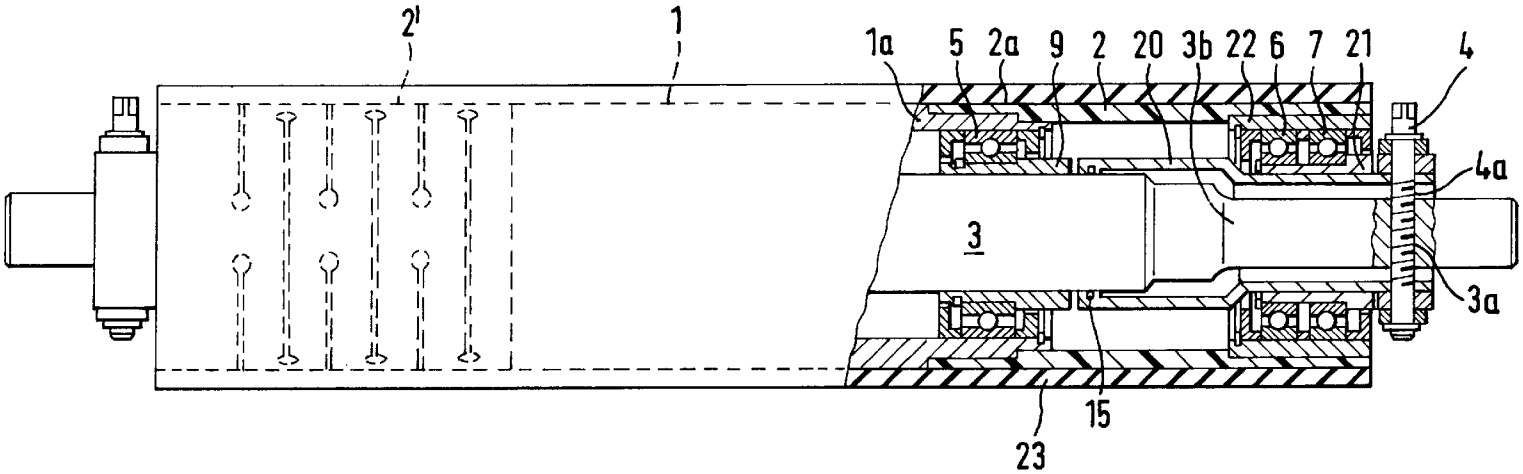
FIG. 2: A drawing of a guide roller as shown in FIG. 1, with an elastic covering.

Within the overlap areas, of which only 1*a*, 2*a* are shown, the adjacent tube sections 1, 2 or 1', 2' are cemented or bolted to each other. If the guide roller, as shown in FIG. 2, is to be fitted with a rubber covering, it will be possible, as an option, to dispense with a special connection between the adjacent tube sections 2', 1, 2 because the rubber covering 23 joins the tube sections 2, 1, 2' to each other so that they rotate in unison.

In both embodiments, the outer surfaces of all the tube sections are aligned with each other.

What is claimed is:

1. Guide roller for web material in paper-handling machinery including two outer tube sections and at least one middle tube section arranged therebetween, the two outer tube sections and at least one middle tube section being supported on a central shaft through ball bearings, the outer tube sections being adjustable radially relative to the shaft at their outer ends, wherein ends of the at least one middle tube section and one of the outer tube sections fit into each other and are connected directly to each other so as to be non-rotatable, a ball bearing being situated beneath an area of overlap of the at least one middle tube section and one of the outer tube sections and the outer tube sections being configured elastically in the longitudinal direction.

2. Guide roller as defined in claim 1, wherein the two outer tube sections and at least one middle tube section are joined to each other so as to be non-rotatable by a rubber covering that extends across the entire width of the roller.

3. Guide roller as defined in claim 1 wherein the elastically configured outer tube sections incorporates slits that extend part way around the periphery of the outer tube sections and are offset relative to each other in the axial direction.

4. Guide roller as defined in claim 1 wherein the outer tube sections are made of plastic.

* * * * *